US005404855A

United States Patent [19]

Yen et al.

[11] Patent Number: 5,404,855

[45] Date of Patent: Apr. 11, 1995

[54] VARIABLE DISPLACEMENT HIGH PRESSURE PUMP FOR FUEL INJECTION SYSTEMS

[75] Inventors: Bai-Mao Yen; Lester L. Peters; Julius P. Perr; Bryan W. Swank, all of Columbus, Ind.

[73] Assignee: Cummins Engine Company, Inc., Columbus, Ind.

[21] Appl. No.: 268,669

[22] Filed: Jun. 30, 1994

Related U.S. Application Data

[63] Continuation of Ser. No. 57,510, May 6, 1993.

[51] Int. Cl.[6] ..... F02M 37/04; F02M 7/00

[52] U.S. Cl. ..... 123/446; 123/456; 123/495; 123/502

[58] Field of Search ..... 123/446, 456, 501, 506, 123/502, 462; 417/212, 215

[56] References Cited

U.S. PATENT DOCUMENTS

| | | | |
|---|---|---|---|
| 4,129,253 | 12/1978 | Bader, Jr. et al. | 239/88 |
| 4,235,374 | 11/1980 | Walter et al. | 123/456 |
| 4,250,857 | 2/1981 | Taplin | 123/448 |
| 4,279,385 | 7/1981 | Straubel et al. | 239/90 |
| 4,284,588 | 8/1981 | Hallberg | 123/462 |
| 4,387,686 | 6/1983 | LeBlanc et al. | 123/446 |
| 4,396,151 | 8/1983 | Kato et al. | 123/446 |
| 4,399,793 | 8/1983 | Poore et al. | 123/502 |
| 4,402,456 | 9/1983 | Schneider | 239/90 |
| 4,418,867 | 12/1983 | Sisson | 239/88 |
| 4,469,070 | 9/1984 | Rassey | 123/462 |
| 4,489,886 | 12/1984 | Kato | 239/88 |
| 4,502,445 | 3/1985 | Roca-Nierga et al. | 123/458 |
| 4,531,672 | 7/1985 | Smith | 123/446 |
| 4,621,605 | 11/1986 | Carey, Jr. et al. | 123/446 |
| 4,660,522 | 4/1987 | Babitzka | 417/462 |
| 4,777,921 | 10/1988 | Miyaki et al. | 123/456 |
| 4,951,631 | 8/1990 | Eckert | 123/501 |
| 4,971,016 | 11/1990 | Peters et al. | 123/446 |
| 5,035,221 | 7/1991 | Martin | 123/451 |
| 5,058,553 | 10/1991 | Kondo et al. | 123/456 |
| 5,094,216 | 3/1992 | Miyaki et al. | 123/456 |
| 5,109,822 | 5/1992 | Martin | 123/456 |
| 5,133,645 | 7/1992 | Crowley et al. | 417/279 |
| 5,168,855 | 12/1992 | Stone | 123/456 |
| 5,186,138 | 2/1993 | Hashimoto | 123/456 |

*Primary Examiner*—Carl S. Miller
*Assistant Examiner*—Thomas N. Moulis
*Attorney, Agent, or Firm*—Sixbey, Friedman, Leedom & Ferguson

[57] ABSTRACT

A variable displacement high pressure pump having a plurality of high pressure pumping units which receive fuel from a low pressure fuel pump. A rotary cam-driven roller tappet, for producing pumping displacement of the pumping plunger of a respective pumping element, is connected to the pumping plunger by a separated link in a manner permitting the pumping plunger to float relative to the roller tappet during at least a portion of each pumping cycle. As a result, the capacity of the pumping chamber can be limited to an extent that is less than the full stroke achievable by the pumping plunger being retracted to the maximum extent which is permitted by the driving cam. In this way, the quantity of fuel to be pressurized and injected into the common rail does not have to be determined by a cutting-off of a spilling flow of excess metered fuel during the compression stroke of the pumping plunger, so that a low pressure solenoid valve can be used, in the case of time-stroke and time-pressure metering, and no solenoid is required to control metering in the case of pressure-time metering.

22 Claims, 6 Drawing Sheets

VARIABLE DISPLACEMENT HIGH PRESSURE PUMP FOR FUEL INJECTION SYSTEMS

This application is a continuation of application Ser. No. 08/057,510, filed May 6, 1993, now abandoned.

BACKGROUND OF THE INVENTION

1. Field of the Invention

The present invention relates to variable discharge high pressure pumps for supplying metered quantities of fuel to a common rail of a diesel engine.

2. Description of Related Art

Conventional variable displacement high pressure pumps typically have a plurality of pumping elements, each of which comprises a pumping chamber in which a pumping plunger is reciprocated by a rotary cam, and to which fuel is supplied at low pressure (approximately 40 psi.) by a low pressure pump. Examples of such high pressure pumps can be found in, e.g., U.S. Pat. Nos. 5,133,645; 5,094,216; 5,058,553, 4,777,921 and 4,502,445.

Furthermore, usually, a high pressure pump will have two to four pumping elements, depending on pumping capacity, and a respective solenoid valve is used to control the quantity of fuel metered into each of the pumping units. For cost and other reasons, it is desirable to enable metering of fuel into the pumping chambers of a plurality of pumping units to be controlled by no more than a single solenoid valve.

In operation, conventional variable displacement high pressure pumps maintain the solenoid valves in a normally open position and fuel flows into and fills the pumping chambers during the retraction stroke of the pumping plunger. When the pumping plunger starts its compression stroke, fuel spills through the open solenoid valve until it receives a command signal to close. At that point, the fuel remaining in the pumping chamber is trapped and pressurized by the pumping plunger which causes the fuel to flow to the common rail at high pressure. Since the solenoids are caused to close during the compression stroke of the pumping plunger, they must act against the high pressure (15 kpsi. or higher) of the spilling fuel to seal. Thus, for durability and cost reasons, there is a need for a high pressure variable displacement pump which can use solenoid valves which need only be able to act in a low pressure range (e.g., about 40 to 100 psi.).

U.S. Pat. Nos. 5,109,822 and 5,035,221, disclose high pressure common rail fuel injection systems for diesel engines in which a pair of pumping elements is controlled by the same solenoid valve. However, both of the pumping elements of the pair that is controlled by the same solenoid valve are filled and discharged in unison, and to enable fuel to be supplied to the common rail when that pair of pumping elements is being filled, a second pair of pumping elements is provided which is controlled by a second solenoid valve. Thus, it is deskable to be achieve a manner of controlling a plurality of pumping elements via a single solenoid which would enable the pumping elements to be supplied with fuel at different times.

Metering of fuel can be controlled in accordance with a number of different techniques, such as (1) time/-stroke metered (TS), (2) time metered at a constant pressure (TP), and (3) pressure metered at a constant time interval (PT). Normally, a fuel injection system is designed to operate under only a given one of these or other metering principles, with cost and size constraints governing the selection more than any other factor. As such, it would be advantageous to have a variable displacement high pressure pump which is readily adaptable to operation in accordance with any of the noted, TS, TP, and PT, metering techniques.

SUMMARY OF THE INVENTION

It is an object of the present invention to provide a variable displacement high pressure pump in which metering of fuel into the pumping chambers of a plurality of pumping units is controlled by no more than a single solenoid valve in a manner which enables pumping elements to be supplied with fuel at different times.

In conjunction with the preceding object, it is an object of the present invention to enable metering of fuel into the pumping chambers of a plurality of pumping units to be controlled in a manner which enables the use of solenoid valves which need only be able to act in a low pressure range (e.g., about 40 to 100 psi.).

A further object of the present invention is to provide a variable displacement high pressure pump which is readily adaptable to operation in accordance with any of the TS, TP, and PT, metering techniques.

It is a specific object of the present invention to provide a variable displacement high pressure pump which the pumping plunger of the pumping elements is not constrained to follow the complete cycle of movement of its associated driving cam and tappet.

These objects, and others, are achieved in accordance with preferred embodiments of a variable displacement high pressure pump in accordance with the present invention in which each of a plurality of high pressure pumping elements receives fuel from a low pressure fuel pump, each pumping unit having a rotary cam-driven roller tappet, for producing pumping displacement of the pumping plunger of the pumping element, which is connected to the respective pumping plunger by a separated link in a manner permitting the pumping plunger to float relative to the roller tappet during at least a portion of each pumping cycle, thereby enabling the capacity of the pumping chamber to be limited to an extent that is less than the full stroke achievable by the pumping plunger being retracted to maximum extent which is permitted by the driving cam. In this way, the quantity of fuel to be pressurized and injected into the common rail does not have to be determined by a cutting-off of a spilling flow of excess metered fuel during the compression stroke of the pumping plunger, so that a low pressure solenoid valve can be used, in the case of TS and TP metering and no solenoid is required to control metering in the case of PT metering.

In the situation where the variable displacement high pressure pump according to the invention is to be used for metering of fuel into the pumping chamber on a time/stroke basis, a separated link connects the pumping plunger with the roller tappet via a link plunger that is articulated to the roller tappet; a fuel supply line having a check valve at the fuel supply inlet of each of the pumping elements is connected to the outlet of the low pressure pump for supplying a first flow of fuel from the low pressure pump to each pumping chamber; a single solenoid valve is provided for controlling a second flow of fuel from the outlet of the low pressure pump to a metering orifice at an inlet to a portion of the bore that is disposed between the pumping plunger and the link plunger of each of the high pressure pumping elements; and the portion of the bore between the pumping plunger and the link plunger is communicated with a drain port during part of each pumping cycle. The separated link can comprise a spring that acts between the pumping plunger and the link plunger.

When the variable displacement high pressure pump according to the invention is to be used for metering of fuel into the pumping chamber on a time-pressure basis, a single solenoid valve is provided for controlling a time metered flow of a constant-pressure supply of fuel from the outlet of the low pressure pump to the pumping chamber of each of the pumping elements, a check valve being located at each fuel supply inlet for preventing a return flow of fuel from the pumping chamber. In this case, the separated link can comprise a spring acting between the pumping plunger and the roller tappet, the link plunger being eliminated.

Still further, if the variable displacement high pressure pump according to the invention is to be used for metering of fuel into the pumping chamber on a pressure-time basis, a variable orifice is provided for controlling the pressure of a pressure metered flow of a supply of fuel from the outlet of the low pressure pump to the pumping chamber of each of the pumping elements during a constant time window, a check valve being located at each fuel supply inlet for preventing a return flow of fuel from the pumping chamber and a flow control orifice being located at the inlet, downstream of said check valve. Here again, the separated link can comprise a spring acting between the pumping plunger and the roller tappet.

In none of these cases is more than a single solenoid required, and in no case does the solenoid have to be able to seal against very high pressure forces. In each of these cases, a check valve prevents backflow from the pumping chamber and only in the situation of T-P metering is a solenoid valve even in the flow path between the low pressure pump and the pumping chamber, into which fuel from said low pressure pump is metered. The single solenoid valve provided when TS metering is to be produced is in a second path that is not subjected to the high pressure which is imposed on the fuel metered into the pumping plunger.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
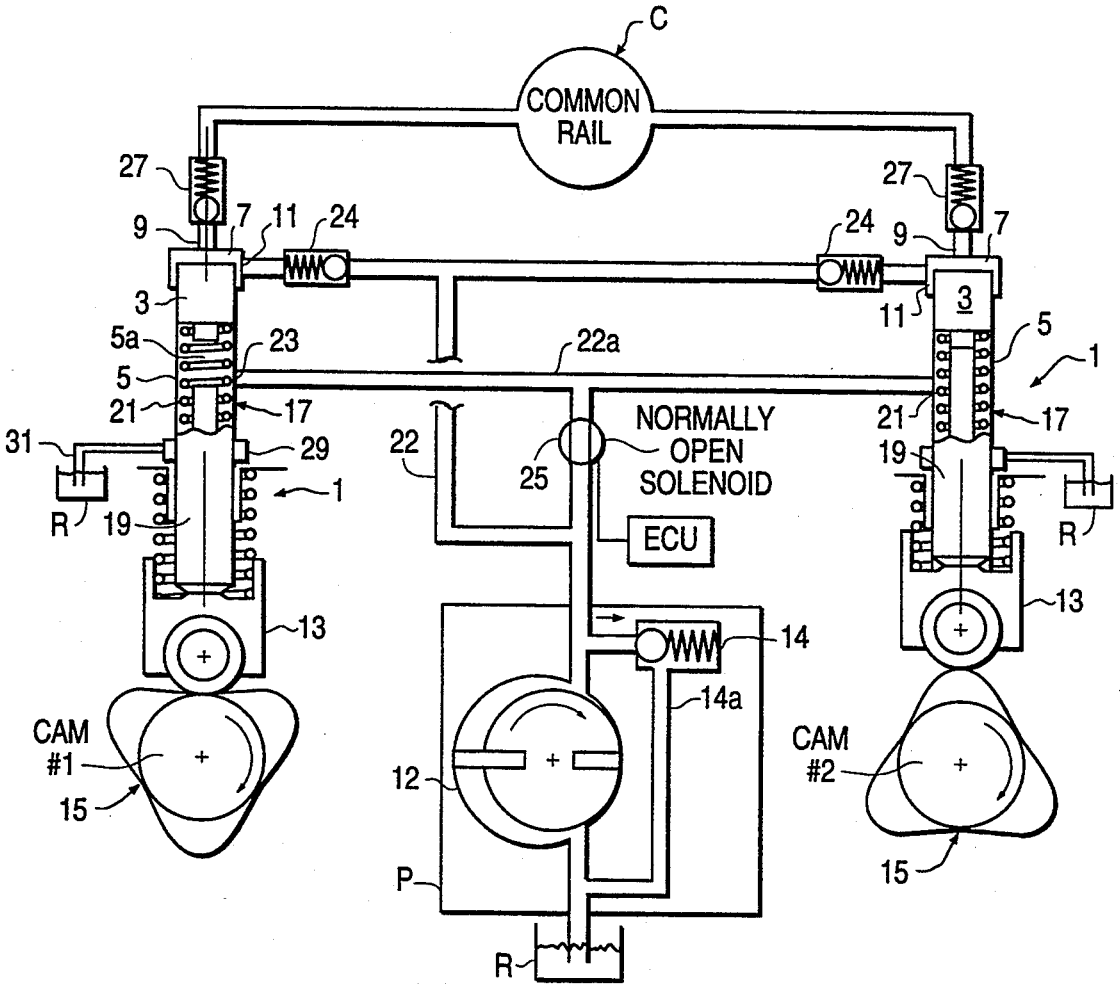
FIG. 1 schematically depicts a variable displacement high pressure pump in which metering occurs using the time/stroke metering principle.

While several embodiments of a variable displacement high pressure pump for a fuel injection system are described herein, numerous components thereof remain unchanged from embodiment to embodiment. Such components that are common to all embodiments are designated by the same reference numerals throughout this specification.

In particular, in all cases, the high pressure pump has a plurality of pumping elements 1, the number of which will depend on capacity, and while only two pumping elements 1 are shown, a greater number may be provided. Each of the pumping elements has a pumping plunger 3 that is mounted for reciprocation in a cylinder bore 5. A variable volume pumping chamber 7 is formed in the bore 5, between an end of the pumping plunger 3 and an outlet 9 of the pumping element through which fuel pressurized by said pumping plunger 3 is supplied to a common rail C of a fuel injection system.

Fuel is supplied from a fuel reservoir R, such as a vehicle fuel tank, by a low pressure supply pump P to an inlet 11 of the pumping chamber 7. The low pressure supply pump P comprises, for example, a vane pump 12 with a pressure regulator 14 that insures a supply of fuel at a constant low pressure of about 40–100 psi.

A roller tappet 13 rides along the lobes of a rotary cam 15 (there being three lobes in the illustrated examples) and produces pumping displacement of the pumping plunger 3 via a separated link 17; this separated link is described in greater detail below with respect to the specific embodiments and permits the pumping plunger 3 to float relative to the roller tappet 13 during at least a portion of each pumping cycle. This separated link 17 enables the capacity of the pumping chamber 7 to be limited to an extent that is less than the full stroke which would be achieved if the pumping plunger 3 were retracted to the maximum extent which is permitted by the rotary cam 15. In this way, the quantity of fuel to be pressurized and injected into the common rail C does not have to be determined by a cuffing-off of a spilling flow of excess metered fuel during the compression stroke of the pumping plunger 3. This benefit is achieved regardless of whether metering is achieved in accordance with TS, TP or PT metering principles, as will be apparent from the following description of three variable displacement high pressure pump embodiments, each of which is designed to function on the basis of a respective one of these three metering principles.

An important application of the present invention is in fuel systems of the common rail type wherein it is used to carefully control the pressure in a common rail, such as disclosed in U.S. Pat. Nos. 4,777,921 and 5,094,216, disclosed in commonly owned, copending application Ser. No. 08,057,489, entitled Compact High Performance Fuel System with Accumulator, the disclosure of this copending application being hereby incorporated by reference.

Figure 2:
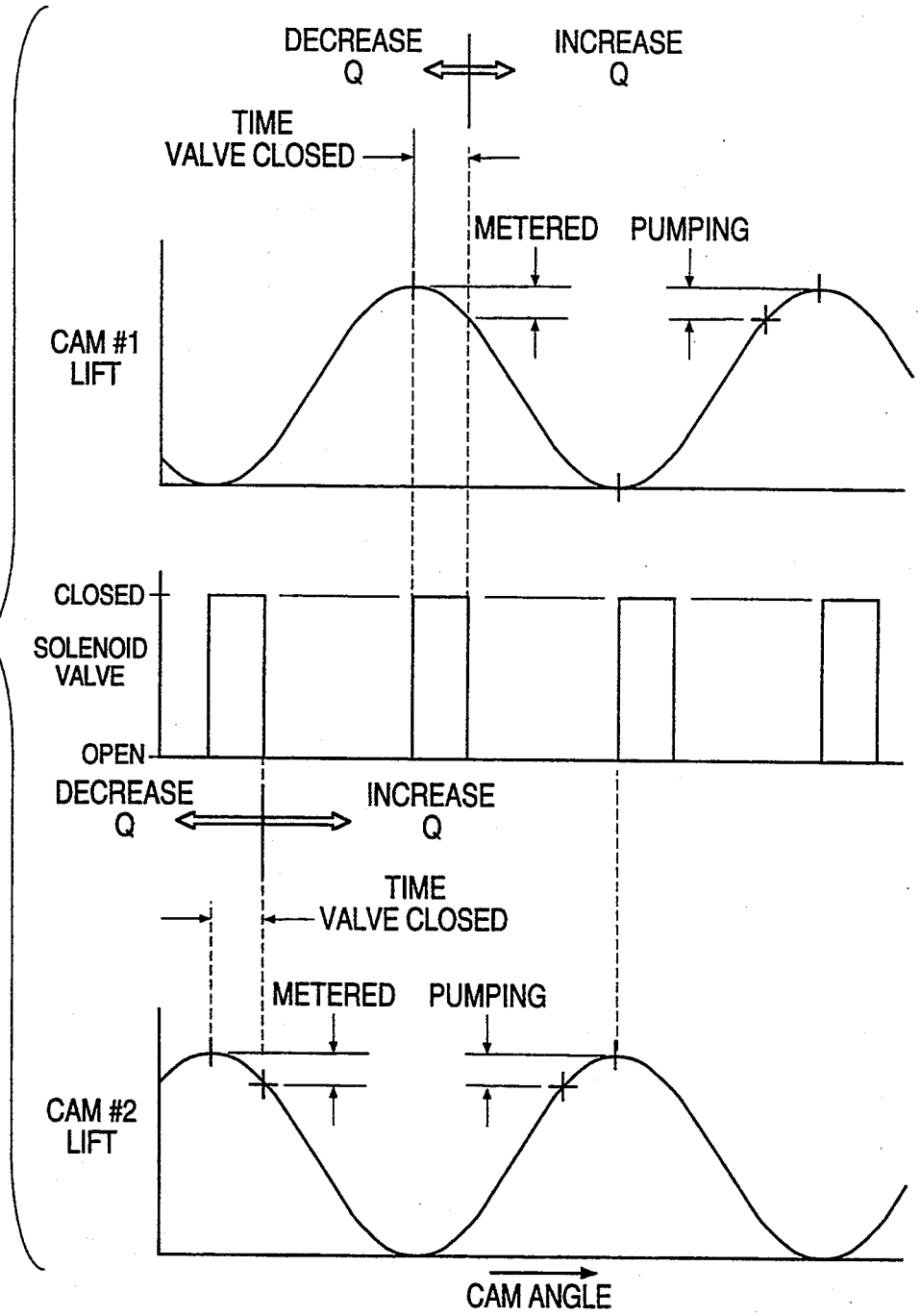
FIG. 2 is a graphic depiction of the relationship of cam lift and solenoid valve position with respect to cam angle, and relative to the occurrence of metering and pumping events in the FIG. 1 pump.

A variable displacement high pressure pump in which metering of fuel into the pumping chamber is produced on a time/stroke basis will now be described relative to FIGS. 1&2. In this case, a fuel supply line 22 having a check valve 24 at the fuel supply inlet 11 of each of the pumping elements 1 is connected to the outlet of the low pressure pump P for supplying a first flow of fuel from the low pressure pump P to each pumping chamber 7. Furthermore, the separated link 17 is comprised of a link plunger 19 that is articulated to the roller tappet 13 and a spring 21 acting between the pumping plunger 3 and the link plunger 19. A secondary flow of fuel is supplied from the outlet of the low pressure pump P to a metering orifice at an inlet 23 to a portion 5*a* of bore 5 that is disposed between the pumping plunger 3 and the link plunger 19 of each of the high pressure pumping elements 1 under the control of a single, normally open, solenoid valve 25 that is located in a branch 22*a* of the fuel supply line 22.

The portion 5*a* of the bore between the pumping plunger 3 and the link plunger 19 is also able to communicate with the reservoir R, via the drain port 14*a* of the pressure regulator 14, and with corresponding bore portion 5*a* of the other high pressure pumping element 1 during part of each pumping cycle. In this way, the separated link 17 connects the pumping plunger 3 with the roller tappet 13 and cam 15 in a manner which permits it to float relative thereto during a portion of the cam cycle while causing the pumping plunger 3 to follow the movement of the link plunger 19 at other times, depending on whether the solenoid valve 25 is open or closed. More specifically, when the solenoid valve 25 is open, the pressures will be balanced at the opposite sides of the pumping plunger 3, and thus, the pumping plunger 3 will float relative to the link plunger 19, e.g., it will not follow downward movement thereof. On the other hand, when the solenoid valve 25 closes, a pressure differential will be created across the pumping plunger 3 which will cause the pumping plunger 3 to follow the link plunger 19.

With the preceding in mind, operation of the FIG. 1 high pressure pump will be described with reference to FIG. 2. Starting with the position shown for the pumping element 1 associated with the rotary cam 15 designated cam #2, as the link plunger starts to retract, due to the tappet 13 having commenced to move off the peak of the cam lobe, a command signal from an electronic control unit (ECU) causes solenoid valve 25 to close. As a result, the pressure difference created causes the pumping plunger 3 to move down with the link plunger 19, so that fuel is metered into the pumping chamber 7 via supply line 22, check valve 24 and inlet 11. When the ECU determines that the prescribed quantity of fuel Q has been metered, a command signal is generated which opens the solenoid valve 25, equalizing the pressure on both sides of pumping plunger 3, thereby bringing it to rest despite continuing downward movement of the link plunger 19, and thus, trapping the metered fuel in the pumping chamber 7. As a result, the metered quantity of fuel Q can be increased and decreased by correspondingly varying the time that the solenoid valve 25 is closed.

When the link plunger starts moving up the next cam lobe, commencing the compression stroke, the fuel in bore portion 5*a* is caused to spill back out through the inlet 23, from which it flows to the fuel reservoir R via the check valve controlled drain port 14*a* of the pressure regulator 14. The fuel spilling from bore portion 5*a* is also in communication with the bore portion 5*a* of the other high pressure pumping element 1, thereby requiring the pressure forces to be balanced between the pumping elements, even though the pressure regulator serves to maintain a constant pressure in branch 22*a* (and therefore, bore portions 5*a*) whenever the solenoid valve 25 is open. For this reason, the metering and pumping phases of one high pressure pumping unit 1 are offset from the metering and pumping phases of the other high pressure pumping unit 1, as shown in FIG. 2, so that the solenoid is never closed when any of the high pressure pumping units is in its pumping phase and never is open when any of the high pressure pumping units is in its metering phase.

Once the link plunger 19 engages the pumping plunger 3, the whole high pressure pumping unit compresses the trapped volume of fuel in pumping chamber 7. Check valve 24 prevents a return flow of fuel and once the pressure of the fuel in the pumping chamber 7 is raised to a prescribed level (in the range of, e.g., 10–15 kpsi.), the pressure exerted by the fuel opens an outlet check valve 27, thereby causing the fuel to be pumped into the common rail C.

Since the solenoid valve 25 only has to close and seal against the low pressure (40–100 psi.) of the fuel from the low pressure pump P, a less expensive and more reliable low pressure range solenoid valve can be used for solenoid valve 25. For example, a solenoid valve of the type used in automotive gasoline fuel injectors.

Any fuel which leaks between the link plunger 19 and the wall of bore 5 is collected in an annulus 29 from which it is able to flow back to the fuel reservoir R via a drain passage 31.

Figure 3:
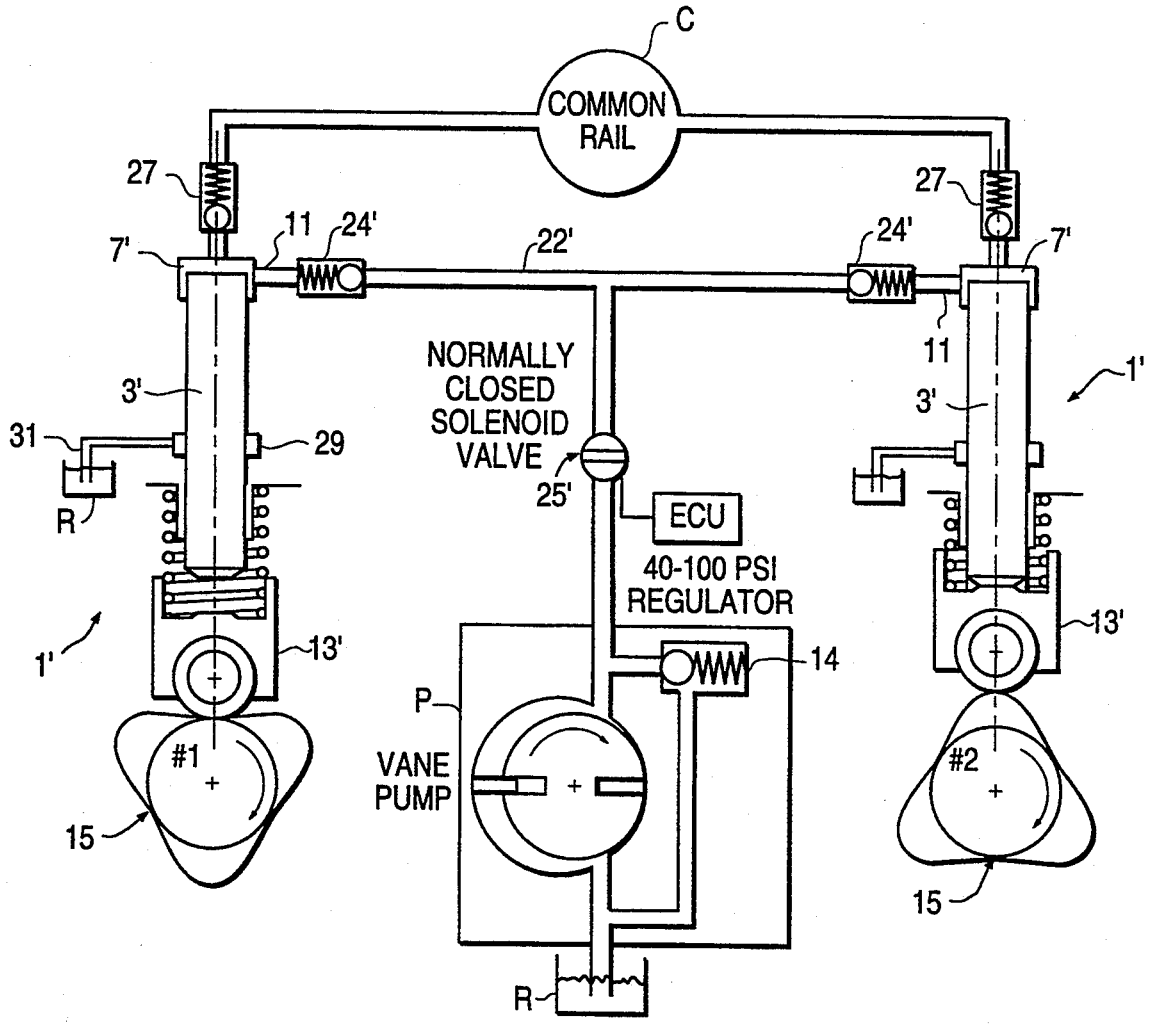
FIG. 3 schematically depicts a variable displacement high pressure pump in which metering occurs using the time-pressure metering principle.
Figure 4:
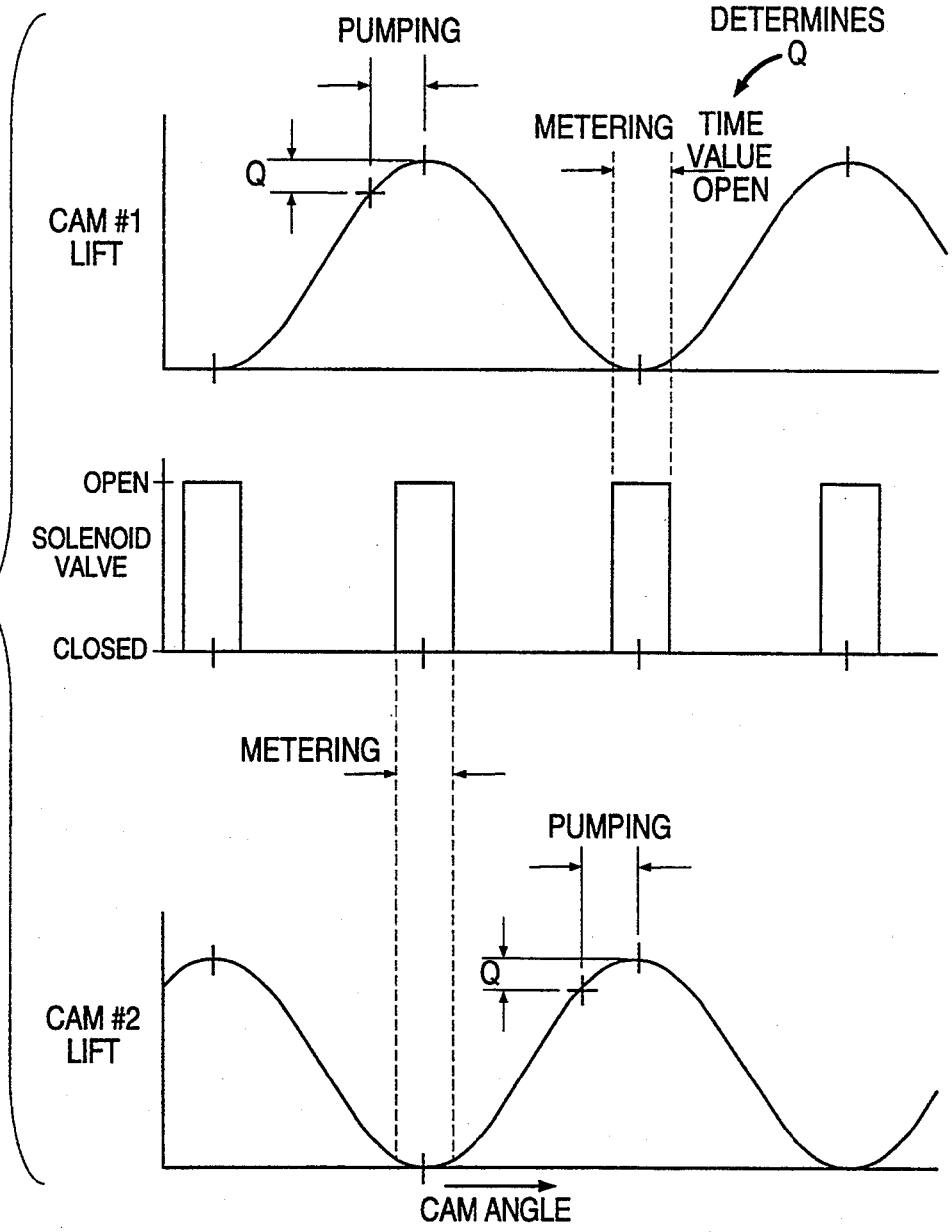
FIG. 4 is a graphic depiction of the relationship of cam lift and solenoid valve position with respect to cam angle, and relative to the occurrence of metering and pumping events in the FIG. 3 pump.

Turning, now, to FIGS. 3 and 4, a variable displacement high pressure pump for metering of fuel into the pumping chambers 3′ of the high pressure pumping units 1′ on a time-pressure basis will be described.

In this case, again, a single solenoid valve 25′ is provided for controlling a time-metered flow of the constant-pressure supply of fuel from the outlet of the low pressure pump P, through supply line 22′, to the pumping chambers 3′ of each of the pumping elements 1′; however, the link plunger 19 and spring 21 have been eliminated. Furthermore, the pumping plunger 3′ is more elongated than that used in the embodiment of FIGS. 1 and 2 (pumping plunger 3′ is slightly longer than the total length of link plunger 17); although, no specific length is required for the pumping plunger 3′ so long as the top of the pumping plunger 3′ remains above the drain annulus 29′ when it is maximally retracted, and the plunger 3′ is able to sufficiently collapse the pumping chamber 7′ when the pumping plunger is fully raised by the action of the rotary cam 15 and roller tappet 13.

The pumping plungers 3′ are separated from the roller tappets 13′, except during pumping of fuel from the pumping chamber 7′, at which time they are connected in abutting fashion. When the solenoid valve 25′ is in its normally closed condition, the pumping plungers will remain stationary since the chamber in which the rotary tappets 13 and cams 15 are located are vented to atmosphere and continued downward movement would be prevented by the creation of a negative pressure in the closed pumping chamber 7′.

Thus, as represented in FIG. 4, metering occurs when the ECU causes the solenoid valve 25′ to open (instead of when it closes in the preceding embodiment); however, despite this change, the solenoid valve still only has to close and seal against the low pressure of pump P since the check valves 24′ isolate the solenoid valve 25′ from the high pressure of the fuel in the pumping chamber 7, which occurs during the compression stroke; although, it is noted that the solenoid valve closes, as shown in FIG. 4, before pumping commences in either pumping unit 1', due to time delay between the point when each tappet 13 starts moving back up under the action of the respective cam 15 and the time when it contacts the end of the respective pumping plunger 3'.

Figure 5:
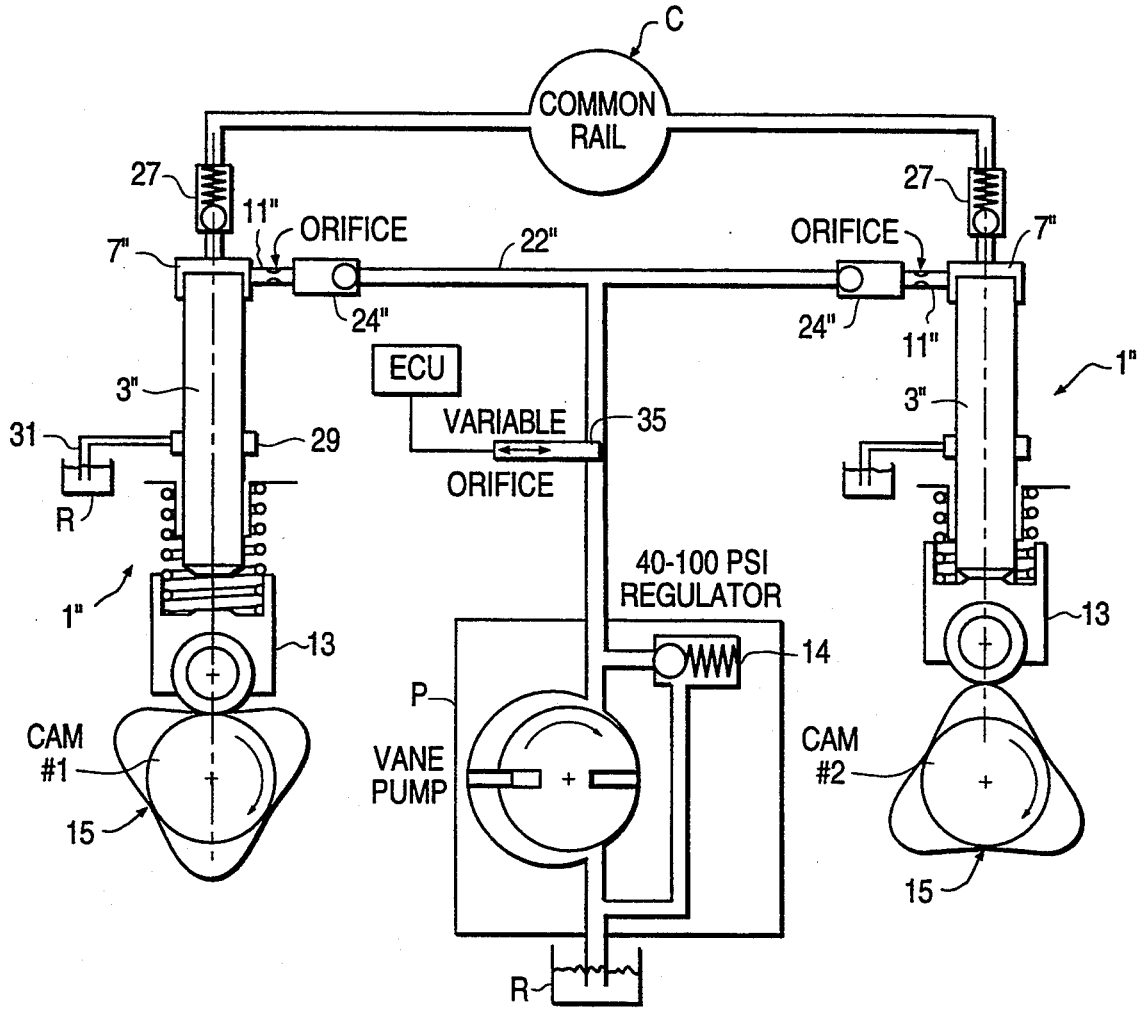
FIG. 5 schematically depicts a variable displacement high pressure pump in which metering occurs using the pressure-time metering principle.

Finally, with reference to FIGS. 5 and 6, a variable displacement high pressure pump for metering of fuel into the pumping chamber on a pressure-time basis will be described.

In this case, a variable orifice 35 is provided for controlling the pressure of a pressure-metered flow of fuel supplied from the outlet of the low pressure pump P to the pumping chamber 7" of each of the pumping elements 1" during a constant time window, a check valve 24" being located at each fuel supply inlet for preventing a return flow of fuel from the pumping chamber and a flow control orifice being located at the supply inlet 11, downstream of the check valve 24". In this regard, the ball 24"*a* of check valve 24" is not spring loaded as is that of check valves 24, 24' since such would adversely affect the sensitivity of the fuel supply, which can be regulated to be as low as 0.5 psi by the variable orifice. In view of the lack of a spring in check valve 24", an unillustrated pin prevents incoming fuel from pushing the ball 24"*a* of the check valve 24" into a position blocking the inlet 11 or its orifice; alternatively, the inlet 11 can be connected to the check valve 24" at a position that is sufficiently offset from path of movement of the ball 24"*a* as to prevent it from being blocked thereby. Apart from these modifications, the structure of this embodiment of FIGS. 5&6 is the same as that of FIGS. 3&4.

Figure 6:
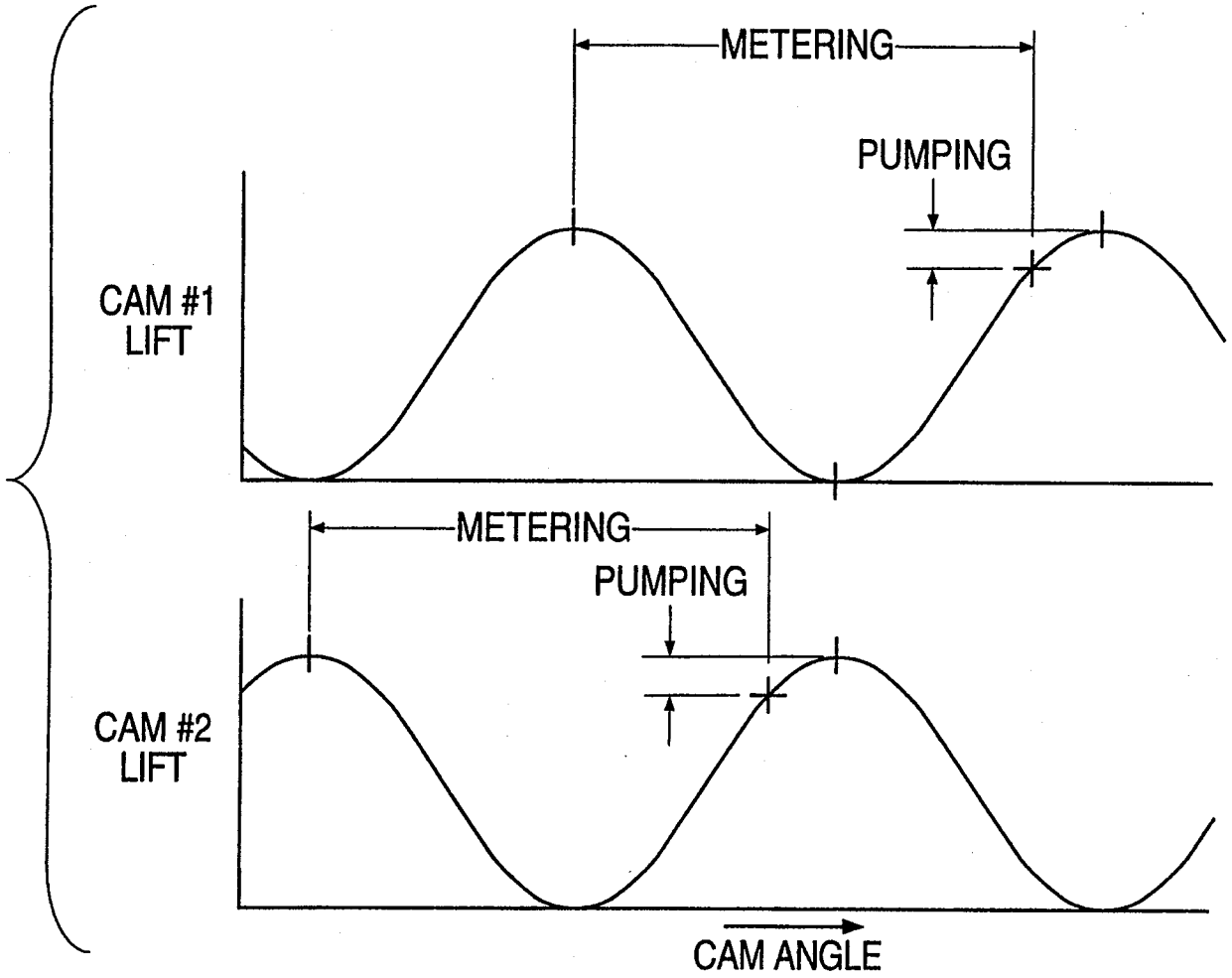
FIG. 6 is a graphic depiction of the relationship of cam lift with respect to cam angle, and relative to the occurrence of metering and pumping events in the FIG. 5 pump.

From the standpoint of operation, as can be seen from FIG. 6, in this embodiment, fuel is metered into each pumping chamber 7" throughout a time period which commences with the retraction of the tappet 13 as it passes top deadcenter of a lobe of its associated cam 15, and does not end until commencement of the pumping phase. That is, fuel is supplied to the pumping chambers 7" at a rate that is dictated by the orifice of inlet 11 and the pressure of the fuel from pump P as set by the variable orifice (under the control of the ECU, in a way that, by itself, is not novel). As fuel enters the pumping chamber 7", the pumping piston 3" moves downwardly only to an extent that corresponds to the quantity of fuel supplied (unlike the tappet 13 which follows the curvature of cam 15) until the upwardly returning tappet 13 engages the pumping piston 3". At this point, the check valve 24" is caused to close and check valve 27 is caused to open due to the pressurization of the fuel in the pumping chamber 7" by the pumping unit formed of the cam 15, tappet 13 and piston 3", which are linked in an abutting fashion during this portion of the pumping cycle.

As pointed out initially, normally, a fuel injection system will be designed to operate under only a specific metering principle (TS, TP, PT or the like) with cost and size constraints governing the selection more than any other factor. However, the present invention is advantageous, nonetheless, because it provides a variable displacement high pressure pump which, starting from the basic characteristics mentioned at the beginning of this Detailed Description, can be readily adapted to operation in accordance with any of the noted, TS, TP, and PT, metering techniques. Furthermore, in those cases where a solenoid valve is required, only a single solenoid valve is required to enable a plurality of pumping elements to be supplied with fuel at different times, and that solenoid valve need only be able to act in a low pressure range (e.g., in the range of about 40 to 100 psi.).

Industrial Applicability

The present invention will find a wide range of applicability as a key component in common rail fuel systems which are used to supply fuel to fuel injectors at high rail pressures, and also in fuel systems for diesel engines in applications requiring minimized emissions and maximized fuel economy.

We claim:

1. A variable displacement high pressure pump for supplying fuel to a common rail fuel injection system having a plurality of fuel injectors connected to a common Eel supply rail, said high pressure pump comprising a low pressure pump having an outlet which is connected to a fuel supply inlet of each of a plurality of high pressure pumping elements; wherein each of the pumping elements has a pumping plunger that is mounted for reciprocation in a bore; wherein a variable volume pumping chamber, into which fuel from said low pressure pump is metered via said fuel supply inlet, is formed in said bore between an end of the pumping plunger and an outlet of the pumping element through which fuel pressurized by said pumping plunger is supplied to a common rail of a common rail fuel injection system; and wherein a rotary cam-driven roller tappet for producing pumping displacement of the pumping plunger is connected to each pumping plunger by a separated link in a manner permitting the pumping plunger to float relative to the roller tappet during at least a portion of each pumping cycle.

2. A variable displacement high pressure pump according to claim 1, wherein, for metering of fuel into the pumping chamber on a time/stroke basis, said separated link connects said pumping plunger with said roller tappet via a link plunger that is articulated to the roller tappet; wherein a fuel supply line having a check valve at the fuel supply inlet of each of the pumping elements is connected to the outlet of said low pressure pump for supplying a first flow of fuel from the low pressure pump to each pumping chamber; wherein a single solenoid valve is provided for controlling a second flow of fuel from the outlet of the low pressure pump to metering orifices of all of said plurality of high pressure pumping elements, each .of said metering orifices being located at an inlet to a portion of said bore that is disposed between the pumping plunger and the link plunger of a respective one of said plurality of high pressure pumping elements; and wherein said portion of the bore between the pumping plunger and the link plunger is communicated with a drain port during part of each pumping cycle.

3. A variable displacement high pressure pump according to claim 2, wherein said separated link comprises a spring acting between the pumping plunger and the link plunger.

4. A variable displacement high pressure pump for a common rail fuel injection .system comprising a low pressure pump having an outlet which is connected to a fuel supply inlet of each of a plurality of high pressure pumping elements; wherein each of the pumping elements has a pumping plunger that is mounted for reciprocation in a bore; wherein a variable volume pumping chamber, into which fuel from said low pressure pump is metered via said fuel supply inlet, is formed in said bore between an end of the pumping plunger and an outlet of the pumping element through which fuel pressurized by said pumping plunger is supplied to a common rail of a fuel injection system; wherein a rotary cam-driven roller tappet for producing pumping displacement of the pumping plunger is connected to each pumping plunger by a separated link in a manner permitting the pumping plunger to float relative to the roller, tappet during at least a portion of each pumping cycle; and wherein, for metering of fuel into the pumping chamber on a time-pressure basis, a single solenoid valve is provided for controlling a time metered flow of a constant-pressure supply of fuel from the outlet of the low pressure pump to the pumping chamber of each of the pumping elements, a check valve being located at each fuel supply inlet for preventing a return flow of fuel from the pumping chamber.

5. A variable displacement high pressure pump according to claim 4, wherein said separated link comprises a free-floating relationship between the pumping plunger and the roller tappet in which said tappet is connected to the pumping plunger, in an abutting manner, only during a pumping phase for pressurizing and injecting fuel from said pumping chamber.

6. A variable displacement high pressure pump according to claim 1, wherein, for metering of fuel into the pumping chamber on a pressure-time basis, a variable orifice is provided for controlling the pressure of a pressure metered flow of a supply of fuel from the outlet of the low pressure pump to the pumping chamber of each of the pumping elements during a constant time window, a check valve being located at each fuel supply inlet for preventing a return flow of fuel from the pumping chamber and a flow control orifice being located at said inlet, downstream of said check valve.

7. A variable displacement high pressure pump according to claim 6, wherein said separated link comprises a free-floating relationship between the pumping plunger and the roller tappet in which said tappet is connected to the pumping plunger, in an abutting manner, only during a pumping phase for pressurizing and injecting fuel from said pumping chamber.

8. A variable displacement high pressure pump according to claim 1, wherein said separated link comprises a free-floating relationship between the pumping plunger and the roller tappet in which said tappet is connected to the pumping plunger, in an abutting manner, only during a pumping phase for pressurizing and injecting fuel from said pumping chamber.

9. A variable displacement high pressure pump for a fuel injection system comprising a constant low pressure pump having an outlet which is connected to a fuel supply inlet of each of a plurality of high pressure pumping elements; wherein each of the pumping elements has a pumping plunger that is mounted for reciprocation in a bore; wherein a variable volume pumping chamber, into which fuel from said low pressure pump is metered via said fuel supply inlet, is formed in said bore between an end of the pumping plunger and an outlet of the pumping element through which fuel pressurized by said pumping plunger is supplied to a fuel injection system; and wherein a single solenoid valve controls fuel flow from said low pressure pump to said plurality of high pressure pumping elements at different time intervals.

10. A variable displacement high pressure pump according to claim 9, wherein a fuel supply line having a check valve at the fuel supply inlet of each of the pumping elements is connected to the outlet of said low pressure pump for supplying a first flow of fuel from the low pressure pump to each pumping chamber; wherein the single solenoid valve is provided in a second flow of fuel from the outlet of the low pressure pump to a metering orifice at an inlet to a portion of said bore that is disposed at an opposite side of said pumping plunger relative to said pumping chamber; and wherein said portion of the bore at the opposite side of the pumping plunger is communicated with a drain port during part of each pumping cycle.

11. A variable displacement high pressure pump according to claim 10, wherein a rotary cam-driven roller tappet for producing pumping displacement of the pumping plunger is connected to each pumping plunger by a separated link in a manner permitting the pumping plunger to float relative to the roller tappet during at least a portion of each pumping cycle.

12. A variable displacement high pressure pump according to claim 11, wherein said separated link connects said pumping plunger with said roller tappet via a link plunger that is articulated to the roller tappet; and wherein the portion of said bore that is disposed at the opposite side of the pumping plunger is formed between the pumping plunger and the link plunger of each of said plurality of high pressure pumping elements.

13. A variable displacement high pressure pump according to claim 11, wherein said separated link comprises a free-floating relationship between the pumping plunger and the link plunger in which said tappet is connected to the pumping plunger, in an abutting manner, only during a pumping phase for pressurizing and injecting fuel from said pumping chamber.

14. A variable displacement high pressure pump according to claim 9, wherein said separated link comprises a free-floating relationship between the pumping plunger and the link plunger in which said tappet is connected to the pumping plunger, in an abutting manner, only during a pumping phase for pressurizing and injecting fuel from said pumping chamber.

15. A variable displacement high pressure pump for supplying high pressure fuel to a high pressure fuel accumulator of a fuel injection system having a plurality of fuel injectors, said high pressure pump comprising a low pressure pump having an outlet which is connected to a fuel supply inlet of each of a plurality of high pressure pumping elements; wherein each of the pumping elements has a pumping plunger that is mounted for reciprocation in a bore; wherein a variable volume pumping chamber, into which fuel from said low pressure pump is metered via said fuel supply inlet, is formed in said bore between an end of the pumping plunger and an outlet of the pumping element through which fuel pressurized by said pumping plunger is supplied to said high pressure fuel accumulator of the fuel injection system; and wherein a rotary cam-driven roller tappet for producing pumping displacement of the pumping plunger is connected to each pumping plunger by a separated link in a manner permitting the pumping plunger to float relative to the roller tappet during at least a portion of each pumping cycle.

16. A variable displacement high pressure pump according to claim 15, wherein, for metering of fuel into the pumping chamber on a time/stroke basis, said separated link connects said pumping plunger with said roller tappet via a link plunger that is articulated to the roller tappet; wherein a fuel supply line having a check valve at the fuel supply inlet of each of the pumping elements is connected to the outlet of said low pressure pump for supplying a first flow of fuel from the low pressure pump to each pumping chamber; wherein a single solenoid valve is provided for controlling a second flow of fuel from the outlet of the low pressure pump to metering orifices of all of said plurality of high pressure pumping elements, each of said metering orifices being located at an inlet to a portion of said bore that is disposed between the pumping plunger and the link plunger of a respective one of said plurality of high pressure pumping elements; and wherein said portion of the bore between the pumping plunger and the link plunger is communicated with a drain port during part of each pumping cycle.

17. A variable displacement high pressure pump according to claim 16, wherein said separated link comprises a spring acting between the pumping plunger and the link plunger.

18. A variable displacement high pressure pump for a fuel injection system comprising a low pressure pump having an outlet which is connected to a fuel supply inlet of each of a plurality of high pressure pumping elements; wherein each of the pumping elements has a pumping plunger that is mounted for reciprocation in a bore; wherein a variable volume pumping chamber, into which fuel from said low pressure pump is metered via said fuel supply inlet, is formed in said bore between an end of the pumping plunger and an outlet of the pumping element through which fuel pressurized by said pumping plunger is supplied to an accumulator of a fuel injection system; wherein a rotary cam-driven roller tappet for producing pumping displacement of the pumping plunger is connected to each pumping plunger by a separated link in a manner permitting the pumping plunger to float relative to the roller tappet during at least a portion of each pumping cycle; and wherein, for metering of fuel into the pumping chamber on a time-pressure basis, a single solenoid valve is provided for controlling a time metered flow of a constant-pressure supply of fuel from the outlet of the low pressure pump to the pumping chamber of each of the pumping elements, a check valve being located at each fuel supply inlet for preventing a return flow of fuel from the pumping chamber.

19. A variable displacement high pressure pump according to claim 18, wherein said separated link comprises a free-floating relationship between the pumping plunger and the roller tappet in which said tappet is connected to the pumping plunger, in an abutting manner, only during a pumping phase for pressurizing and injecting fuel from said pumping chamber.

20. A variable displacement high pressure pump according to claim 15, wherein, for metering of fuel into the pumping chamber on a pressure-time basis, a variable orifice is provided for controlling the pressure of a pressure metered flow of a supply of fuel from the outlet of the low pressure pump to the pumping chamber of each of the pumping elements during a constant time window, a check valve being located at each fuel supply inlet for preventing a return flow of fuel from the pumping chamber and a flow control orifice being located at said inlet, downstream of said check valve.

21. A variable displacement high pressure pump according to claim 20, wherein said separated link comprises a free-floating relationship between the pumping plunger and the roller tappet in which said tappet is connected to the pumping plunger, in an abutting manner, only during a pumping phase for pressurizing and injecting fuel from said pumping chamber.

22. A variable displacement high pressure pump according to claim 15, wherein said separated link comprises a free-floating relationship between the pumping plunger and the roller tappet in which said tappet is connected to the pumping plunger, in an abutting manner, only during a pumping phase for pressurizing and injecting fuel from said pumping chamber.

* * * * *